US006146475A

United States Patent [19]

Kosa

[11] Patent Number: 6,146,475

[45] Date of Patent: Nov. 14, 2000

[54] FREE-MACHINING MARTENSITIC STAINLESS STEEL

[75] Inventor: Theodore Kosa, Reading, Pa.

[73] Assignee: CRS Holdings, Inc., Wilmington, Del.

[21] Appl. No.: 09/273,620

[22] Filed: Mar. 22, 1999

Related U.S. Application Data

[63] Continuation of application No. 09/008,264, Jan. 16, 1998, abandoned.

[51] Int. Cl.[7] ..... C22C 38/18; C22C 38/06

[52] U.S. Cl. ..... 148/325; 420/42

[58] Field of Search ..... 148/325; 420/42

[56] References Cited

U.S. PATENT DOCUMENTS 3,401,035 9/1968 Moskowitz et al. .
4,594,115 6/1986 Lacoude et al. .
5,362,337 11/1994 Kosa .

FOREIGN PATENT DOCUMENTS 0629714 12/1994 European Pat. Off. .

OTHER PUBLICATIONS

Clarke, W.C., "Which free–machining chromium stainless", Metalworking Production, (Sep. 9, 1964).
"Project 70® Stainless Type 416", Alloy Data Sheet, Carpenter Technology Corporation (1986).

*Primary Examiner*—Deborah Yee
*Attorney, Agent, or Firm*—Dann, Dorfman, Herrell and Skillman, P.C.

[57] ABSTRACT

A corrosion resistant, martensitic stainless steel alloy is disclosed having the following composition in weight percent.

| | wt. % |
|---|---|
| Carbon | 0.06–0.10 |
| Manganese | 0.50 max. |
| Silicon | 0.40 max. |
| Phosphorus | 0.060 max. |
| Sulfur | 0.15–0.55 |
| Chromium | 12.00–12.60 |
| Nickel | 0.25 max. |
| Molybdenum | 0.10 max. |
| Copper | 0.50 max. |
| Nitrogen | 0.04 max. |

and the balance is essentially iron. This alloy provides a unique combination of form tool machinability, corrosion resistance, and hardenability, particularly in the annealed condition (100 HRB max.). The alloy is capable of being hardened to at least 35 HRC.

9 Claims, No Drawings

FREE-MACHINING MARTENSITIC STAINLESS STEEL

This application is a continuation of application Ser. No. 09/008,264 filed Jan. 16, 1998, now abandoned.

FIELD OF THE INVENTION

This invention relates to martensitic stainless steel alloys and in particular to a martensitic stainless steel alloy having a composition that is balanced to provide a unique combination of form-tool machinability, hardness capability, and corrosion resistance.

BACKGROUND OF THE INVENTION

A.I.S.I. Type 416 alloy is a hardenable martensitic stainless steel alloy that provides a higher level of machinability relative to other known grades of martensitic stainless steels. The ASTM, UNS, and AMS standard compositions for Type 416 alloy are as follows, in weight percent.

| | ASTM | UNS | AMS |
|---|---|---|---|
| C | 0.15 max. | 0.15 max. | 0.15 max. |
| Mn | 1.25 max. | 1.25 max. | 2.50 max. |
| Si | 1.00 max. | 1.00 max. | 1.00 max. |
| P | 0.06 max. | 0.060 max. | 0.060 max. |
| S | 0.15 min. | 0.15 min. | 0.15–0.40 |
| Cr | 12.00–14.00 | 12.00–14.00 | 11.50–13.50 |
| Ni | — | — | 0.75 max. |
| Mo | 0.60 max. | 0.60 max. | 0.60 max.[1] |
| Cu | — | — | 0.50 max. |
| Fe | Bal. | Bal. | Bal. |

[1]Mo or Zr

Modifications to the basic Type 416 alloy have been made to improve it machinability by including a positive addition of manganese or a combination of tellurium, aluminum, and copper. While those elements are known to benefit the machinability of Type 416 stainless steel, they are also known to detract from such desirable properties such as corrosion resistance and processability when present in too great amounts. Processability relates to the hot workability and ease of melting of the alloy. In addition, the inclusion of such elements in the basic alloy composition results in an alloy that is outside the industry-accepted compositional limits for Type 416 alloy. Customers and potential-customers for Type 416 alloy are reluctant to purchase such modified grades because of uncertainty about the effects of the compositional modifications on the desired properties for the Type 416 alloy other than machinability.

U.S. Pat. No. 3,401,035 relates to a free-machining stainless steel that is based on the Type 416 alloy. That patent discloses that increasing the chromium-equivalent, and hence the amount of ferrite, in the alloy is beneficial to the drilling machinability of the Type 416 alloy. However, the presence of too much ferrite in a martensitic stainless steel such as Type 416 adversely affects the hardness capability of the alloy such that the high levels of hardness and strength typically specified for that steel are not attainable. The patent indicates that "the principles of the invention" described therein "are equally applicable to steels having either a duplex or ferrite-free microstructure." However, there is no discussion of how the composition of such alloys should be balanced to provide a significant improvement in form tool machinability.

In view of the foregoing, there is a need for a martensitic stainless steel alloy that provides improved form tool machinability relative to the known grades, but which provides at least the same level of hardness capability and corrosion resistance as those grades.

SUMMARY OF THE INVENTION

The disadvantages associated with the known grades of Type 416 stainless steel alloy are solved to a large degree by the alloy in accordance with the present invention. The alloy of this invention is a martensitic stainless steel alloy having a unique combination of machinability and hardness capability. The broad and preferred compositions of the present alloy in weight percent, consist essentially of, about:

| | Broad | Preferred |
|---|---|---|
| Carbon | 0.06–0.10 | 0.06–0.10 |
| Manganese | 0.50 max. | 0.50 max. |
| Silicon | 0.40 max. | 0.35 max. |
| Phosphorus | 0.060 max. | 0.060 max. |
| Sulfur | 0.15–0.55 | 0.15–0.50 |
| Chromium | 12.00–12.60 | 12.00–12.50 |
| Nickel | 0.25 max. | 0.20 max. |
| Molybdenum | 0.10 max. | 0.10 max. |
| Copper | 0.50 max. | 0.50 max. |
| Nitrogen | 0.04 max. | 0.04 max. |

The remainder of the alloy is essentially iron and the usual impurities. The alloy is further characterized by having a very low amount of ferrite in the as-quenched and annealed conditions. To that end the amounts of silicon and chromium present in this alloy are significantly lower than in the known commercial grades. The alloy according to this invention provides significantly improved form-tool machinability with hardness capability that is at least as good as that of the known grades of Type 416 alloy.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the ranges can be used with one or more of the other ranges for the remaining elements. In addition, a minimum or maximum for an element of one preferred embodiment can be used with the minimum or maximum for that element from another preferred embodiment Throughout this application, the term "percent" or the symbol "%" means percent by weight, unless otherwise indicated.

DETAILED DESCRIPTION

The alloy according to the present invention contains a combined amount of carbon and nitrogen to provide a hardness capability of at least about 35 HRC when the alloy is heat treated at about 1825F. for 30 minutes and then air cooled. In order to provide the desired hardness, the alloy contains at least about 0.10% carbon+nitrogen. The presence of too much carbon and nitrogen in this alloy adversely affects the machinability of the alloy, however. Therefore, the combined amount of carbon and nitrogen is restricted to not more than about 0.14%. Individually, about0.06 to 0.10% carbon and a trace amount up to about 0.04% nitrogen are present in this alloy. Within the aforesaid ranges, the amount of nitrogen present in the alloy depends on the amount of carbon that is selected.

Manganese is inevitably present in the alloy of this invention, at least at residual levels. Manganese is preferably restricted to not more than about 0.50% to ensure that the alloy provides the desired level of corrosion resistance, in particular, substantial freedom from corrosive attack during passivation.

Silicon is also inevitably present in this alloy in amounts retained from additions made to deoxidize the alloy during the melting/refining process. However, because silicon promotes the formation of ferrite, its use is restricted such that the retained amount is not more than about 0.40%, and preferably not more than about 0.35%.

Chromium contributes to the good corrosion resistance of this alloy and, therefore, at least about 12.0% chromium is present therein. Chromium also promotes the formation of ferrite in this alloy. Therefore, in order to limit the amount of ferrite present in the alloy, chromium is restricted to not more than about 12.60% and better yet to not more than about 12.50%.

Sulfur is present in this alloy because it combines with available manganese and chromium to form sulfides that benefit the machinability of the alloy. In this regard, at least about 0.15%, better yet at least about 0.20%, and preferably at least about 0.30% sulfur is present in this alloy. Too much sulfur, however, adversely affects the alloy's workability, its corrosion resistance, and its mechanical properties such as ductility. For that reason sulfur is restricted to not more than about 0.55% and better yet to not more than about 0.50% in this alloy. Preferably, this alloy contains about 0.30–0.40% sulfur.

Other elements may be present in this alloy as retained amounts from additions made to the melt for a specific purpose or which are added incidentally through the charge materials used during melting of the alloy. However, the amounts of such elements are controlled so that the machinability, corrosion resistance, and hardness capability of the alloy are not adversely affected. More particularly, nickel and copper are restricted in this alloy because too much of those elements, either alone or in combination, will result in an undesirably high annealed hardness. In that regard, nickel is restricted to not more than about 0.25% and preferably to not more than about 0.20%. Copper is restricted to not more than about 0.50%, and preferably to not more than about 0.25%. Molybdenum, is restricted to not more than about 0.10%, because like chromium, molybdenum promotes the formation of ferrite in this alloy.

Up to about 0.1%, but preferably not more than about 0.05%, selenium can be present in this alloy for its beneficial effect on machinability as a sulfide shape control element Up to about 0.01% calcium can be present in this alloy to promote formation of calcium-aluminum-silicates which benefit the alloy's machinability with carbide cutting tools. A small but effective amount of boron, about 0.0005–0.01%, can be present in this alloy for its beneficial effect on hot workability.

The balance of the alloy is essentially iron, except for the usual impurities found in similar grades of commercially available marrensitic stainless steels. The amounts of such impurities are controlled so that the basic properties of machinability, corrosion resistance, and hardness capability are not adversely affected. For example, phosphorus is considered to be an impurity in this alloy which adversely affects the machinability of the alloy and, therefore, is restricted to not more than about 0.060%, preferably not more than about 0.030%. Very small amounts of cobalt, about 0.10% or less, and vanadium, 0.08% or less, may be present in this alloy without adversely affecting the desired combination of properties. Further, such elements as titanium and zirconium are restricted to not more than about 0.02%, preferably to not more than about 0.01% in order to control the amount of Ti- and Zr-carbonitrides in the alloy, because such phases adversely affect the machinability of this alloy. Similarly, aluminum is restricted to not more than about 0.02%, preferably to not more than about 0.01% to control the amount of aluminum oxides in the alloy, which also adversely affect the machinability of this alloy.

Within the weight percent ranges described hereinabove, the elements are carefully balanced to limit the amount of ferrite in the alloy, but without adversely affecting the hardness capability or corrosion resistance provided by the alloy. It has been found by the inventor that the form-tool machinability provided by this alloy is substantially improved when the amount of ferrite present is restricted to significantly lower levels than usually found in the known grades of Type 416 alloy. To that end the composition of the alloy is balanced such that the amounts of ferrite-forming elements such as chromium and silicon present in the alloy are significantly lower than in the known commercial grades of Type 416 alloy. Since the amount of ferrite in the alloy is directly related to the quantity of ferrite forming elements present, the relative ferrite level can be ascertained by reference to a chromium-equivalent factor. A suitable chromium-equivalent is defined in U.S. Pat. No. 3,401,035 as:

$$\%\ \text{Chromium Equivalent} = \%\ \text{Cr} + \%\ \text{Si} + 1.5\times\%\ \text{Mo} + 10\times\%\ \text{Al} - \%\ \text{Ni} - \%\ \text{Cu} - 30(\%\ \text{C} + \%\ \text{N})$$

Preferably, the % Chromium Equivalent in the alloy according to the present invention is not more than about 9.5%, better yet, not more than about 9.0%, and preferably note more than about 8.75%, as determined by the foregoing formula No special techniques are required in melting, casting, or working the alloy of the present invention. Arc melting followed by argon-oxygen decarburization (AOD) is the preferred method of melting and refining the alloy. However, other practices such as vacuum induction melting (VIM) can be used. This alloy is suitable for use in continuous casting processes and, when desired, can be made by powder metallurgy techniques.

The alloy according to the present invention is hot worked from a furnace temperature of about 2000–2300 F. (1093–1260 C.), preferably 2100–2250 F. (1149–1232 C.), with reheating as necessary after intermediate reductions. The alloy is hardened by austenitizing it at about 1800–1900 F. (982–1038 C.), quenching, preferably in oil, and then tempering or annealing for about 2–8 hours, preferably about 4 hours, at a furnace temperature of about 300–1450 F. (149–788 C.). The alloy is preferably air cooled from the tempering or annealing temperature. Like Type 416 stainless steel, the present alloy can be heat treated to a variety of desired hardnesses, such as 100 HRB max., 26–32 HRC, or 32–38 HRC. The improved machinability provided by this alloy is most pronounced in the annealed condition (100 HRB max.) and when the alloy has been hardened to an intermediate level of hardness (26–32 HRC).

The alloy of the present invention can be formed into a variety of shapes for a wide variety of uses and lends itself to the formation of billets, bars, rod, wire, strip, plate, or sheet using conventional practices. The preferred practice is to continuously cast the alloy into billet form followed by hot rolling the billet to bar, wire, or strip. Such forms are then readily machined into useful components.

WORKING EXAMPLES

In order to demonstrate the unique combination of properties provided by the present alloy, Example 1 thereof having the weight percent composition shown in Table 1 was prepared. For comparison purposes, comparative Heats A and B with compositions outside the range of the present invention, but which are typical of a commercial grade of Type 416 alloy were also prepared. The weight percent compositions of Heats A and B are also shown in Table 1.

TABLE 1

| Element | Ex. 1 | Ht. A | Ht. B |
|---|---|---|---|
| C | 0.093 | 0.095 | 0.084 |
| Mn | 0.41 | 0.40 | 0.40 |
| Si | 0.23 | 0.70 | 0.68 |
| P | 0.017 | 0.016 | 0.021 |
| S | 0.35 | 0.34 | 0.37 |
| Cr | 12.36 | 13.10 | 13.02 |
| Ni | 0.24 | 0.22 | 0.31 |
| Mo | 0.01 | 0.01 | 0.06 |
| Cu | 0.04 | 0.04 | 0.05 |
| Co | 0.02 | 0.02 | 0.03 |
| V | 0.065 | 0.072 | 0.08 |
| N | 0.030 | 0.032 | 0.034 |
| Ti | <0.005 | <0.005 | <0.005 |
| Cb | <0.01 | <0.01 | 0.01 |
| W | <0.02 | <0.02 | <0.02 |
| Zr | <0.005 | <0.005 | <0.005 |
| Fe | Bal. | Bal. | Bal. |

Example 1, Heat A, and Heat B were prepared as commercial-size heats and were arc melted and refined using the AOD process. The maximum quenched hardness of Example 1, 38 HRC, was determined from a sample of as-cast material that was hardened by heating at 1825 F. (996.1 C.)for 30 minutes and then air-cooled. The maximum quenched hardnesses of Heats A and B, 38 HRC and 37.5 HRC respectively, were determined from a mathematical model based on alloy composition.

The three heats were each cast in a continuous caster to form 10 in.×8 in. (25.4 cm×20.32 cm) billets. The billets of Example 1 and Heat A were subdivided into several different portions. Each portion was processed differently so that the machinability of the two alloys could be tested in more than one size and at more than one hardness. More specifically, a portion of the billet of Example 1 and a portion of the billet of Heat A were hot rolled to 0.6875 in. (1.75 cm) round bar from a furnace temperature of 2250 F. (1232.2 C.). The bar was batch annealed at 700 C. for 8 hours and then cooled in air. The annealed bar from each heat was then straightened and cut into lengths which were then turned and polished to 0.625 in. (1.6 cm) round. That process, Process A1, is designed to provide an annealed hardness of not more than 100 HRB (Condition A).

The continuously cast billet of Heat B was hot rolled to 0.656 in. (1.67 cm) round. The hot rolled material was annealed at 780 C. for 8 hours and then air cooled. The annealed bar was then cut into lengths which were straightened, turned and polished to 0.625 in. (1.6 cm) round. A second portion of the heat of Example 1 was processed to 0.625 in. (1.6 cm) round bar as described above, except that it was annealed at 780 C. for 8 hours and then air cooled. The 780 C. annealing process, Process A2, is also designed to provide an annealed hardness of not more than about 100 HRB.

Another portion of the continuously cast billet of Example 1 and a second portion of the continuously cast billet of Heat A were hot rolled to 0.7812 in. (1.98 cm) round bar from a furnace temperature of 2250 F. (1232.2 C.). The bars were batched annealed at 680 C. to 700 C. for 8 hours and then cooled in air. The annealed bar from each heat was then shaved to 0.7512 in. (1.91 cm) round, heated at an austenitizing temperature of 1000 C. for 0.5 hours and then quenched in oil. The as-quenched bars were then tempered at 560 C. for 4 hours and cooled in air. The as-tempered bars were cold drawn to 0.632 in. (1.61 cm) round, straightened, cut into lengths, and then ground to 0.625 in. (1.6 cm) round. That process, identified as T1, is designed to provide a Rockwell hardness of about 26 to 32 HRC (Condition T).

A further portion of the continuously cast billet of Example 1 and a further portion of the continuously cast billet of Heat A were hot rolled to 1.0625 in. (2.7 cm) round bar from a furnace temperature of 2250 F. (1232.2 C.) and then furnace cooled. The bar from each heat was then heated at an austenitizing temperature of 1000 C. for 1 hour and quenched in oil. The as-quenched bars were then tempered at 550 C. for 4 hours and cooled in air. The as-tempered bars were straightened, turned to 1.017 in. (2.58 cm) round, restraightened, and then ground to 1.000 in. (2.54 cm) round. That process, identified as T2, is also designed to provide a Rockwell hardness of about 26 to 32 HRC.

Still further portions of the Example 1 and Heat A billets were hot rolled to 0.6875 in. (1.75 cm) round bar from a furnace temperature of 2250 F. (1232.2 C.) and then furnace cooled. The bar from each heat was then heated at an austenitizing temperature of 1000 C. for 1 hour and then quenched in oil. The as-quenched bars were then tempered at 510 C. for 4 hours and cooled in air. However, the tempered hardness was higher than the desired range and so the bars were re-tempered at 520 C. for 4 hours and air cooled. The as-tempered bars were straightened, turned to 0.637 in. (1.62 cm) round, restraightened, and then ground to 0.625 in. (1.6 cm) round. That process, identified as H1, is designed to provide a Rockwell hardness of about 32 to 38 HRC (Condition H).

The hardnesses of the as-processed bars were measured at the center, at mid-radius, and near the edge thereof. The results of the hardness testing are presented in Table 2 as the average cross-sectional hardness.

TABLE 2

| | Process | Avg. Hardness |
|---|---|---|
| Condition A | | |
| Ex. 1 | A1 | 96 |
| Ht. A | | 98 |
| Ex. 1 | A2 | 92 |
| Ht. B | | 86 |
| Condition T | | |
| Ex. 1 | T1 | 27 |
| Ht. A | | 28 |
| Ex. 1 | T2 | 28 |
| Ht. A | | 28 |
| Condition H | | |
| Ex. 1 | H1 | 32 |
| Ht. A | | 32 |

Hardness values of 80 to 100 are Rockwell B Scale (HRB).
Hardness values of 20 to 35 are Rockwell C Scale (HRC).

Shown in Table 3 are the results of machinability testing of the test specimens from each composition on an automatic screw machine. That test is designed to show the form tool machinability of an alloy as measured by the life of the form cutting tool. Triplicate machinability tests were performed on specimens from the 0.625 in. (1.6 cm) and 1.000 in. (2.54 cm) bars using a procedure based on ASTM Standard Test Procedure E618. A rough form tool feed of 0.002 ipr (0.051 mm/rev) and a water-based cutting fluid emulsion at a 5% concentration were used. A machining speed of 343 surface feet per minute (SFPM) (104.5 m/min.) was used for the specimens heat treated to condition A. For the specimens heat treated to condition T, a machining speed of 257 SFPM (78.3 m/min.) was used for the specimens taken from the 0.625 in. (1.6 cm) bars and a machining speed of 256 SFPM (78.0 m/min.) was used for the specimens taken from the 1000 in. (2.54 cm bars). A machining speed of 206 SFPM (62.8 m/min.) was used for the specimens heat treated to condition H. The results are reported as the number of parts machined (Parts Machined) before the rough-formed diameter of the machined parts grew 0.003 in. (0.076 mm), unless otherwise indicated in the table. The results reported in Tables 3A to 3D were obtained using standard form tools.

TABLE 3A

| 0.625 in. (1.6 cm) round bar in Condition A | | | | |
|---|---|---|---|---|
| Alloy | Process | Parts Machined | Avg. | Std. Dev. |
| Ex. 1 | A1 | 430[1], 420[1], 410[1] | 420 | 10 |
| Ht. A | A1 | 310[1], 230[1], 210[1] | 250 | 53 |
| | | 250[1], 200[1], 260[1] | 237 | 32 |
| Ex. 1 | A2 | 390[1], 490[1], 520[1] | 467 | 68 |
| | | 480, 460, 510 | 483 | 25 |
| Ht. B | A2 | 210[1], 190[1], 270[1] | 223 | 42 |

[1]Tool failed before 0.003 in (0.076 mm) part growth.

TABLE 3B

| 0.625 in. (1.6 cm) round bar in Condition T | | | | |
|---|---|---|---|---|
| Alloy | Process | Parts Machined | Avg. | Std. Dev. |
| Ex. 1 | T1 | 570[1], 450[1], 550[1] | 523 | 64 |
| Ht. A | T1 | 280[1], 370[1], 350[1] | 333 | 47 |

[1]Tool failed before 0.003 in (0.076 mm) part growth.

TABLE 3C

| 1.000 in. (2.54 cm) round bar in Condition T | | | | |
|---|---|---|---|---|
| Alloy | Process | Parts Machined | Avg. | Std. Dev. |
| Ex. 1 | T2 | 340[1], 290[1], 270[1] | 300 | 36 |
| Ht. A | T2 | 210[1], 190[1], 220 | 207 | 15 |

[1]Tool failed before 0.003 in (0.076 mm) part growth.

TABLE 3D

| 0.625 in. (1.6 cm) round bar in Condition H | | | | |
|---|---|---|---|---|
| Alloy | Process | Parts Machined | Avg. | Std. Dev. |
| Ex. 1 | H1 | 430[1], 280[1], 350[1] | 353 | 75 |
| Ht. A | H1 | 320[1], 250[1], 230[1] | 267 | 47 |

[1]Tool failed before 0.003 in (0.076 mm) part growth.

The results reported in Tables 4A to 4C were obtained using form tool inserts instead of the standard form tool.

TABLE 4A

| 0.625 in. (1.6 cm) round bar in Condition A | | | | |
|---|---|---|---|---|
| Alloy | Process | Parts Machined | Avg. | Std. Dev. |
| Ex. 1 | A1 | 490, 480, 540 | 503 | 32 |
| Ht. A | A1 | 190[1], 210[1], 350 | 250 | 87 |
| | | 270[1], 170[1], 170[1] | 203 | 58 |

[1]Tool failed before 0.003 in (0.076 mm) part growth.

TABLE 4B

| 0.625 in. (1.6 cm) round bar in Condition T | | | | |
|---|---|---|---|---|
| Alloy | Process | Parts Machined | Avg. | Std. Dev. |
| Ex. 1 | T1 | 640[1], 640[1], 670[1] | 650 | 17 |
| Ht. A | T1 | 510[1], 610[1], 550[1] | 557 | 50 |

[1]Tool failed before 0.003 in (0.076 mm) part growth.

TABLE 4C

| 0.625 in. (1.6 cm) round bar in Condition H | | | | |
|---|---|---|---|---|
| Alloy | Process | Parts Machined | Avg. | Std. Dev. |
| Ex. 1 | H1 | 340[1], 270[1], 250[1] | 287 | 47 |
| Ht. A | H1 | 320[1], 310[1], 350[1] | 327 | 21 |

[1]Tool failed before 0.003 in (0.076 mm) part growth.

Cone-shaped specimens for corrosion testing were prepared from the 0.625 in. (1.6 cm) round bars of Example 1 and Heat A. The cone specimens have a 60° angle apex and were polished to a 600 grit finish. Triplicate sets from some of the cone specimens were passivated by immersing them in a 5% by weight solution of sodium hydroxide at 160–180° F. (71–82° C.) for 30 minutes and then rinsed in water. The cone specimens were then immersed in a 20 vol % solution of nitric acid ($HNO_3$) containing sodium dichromate at 120–140° F. (49–60° C.) for 30 minutes and rinsed in water again. Finally, the cone specimens were again immersed in 5% by weight solution of sodium hydroxide at 160–180° F. (71–82° C.) for 30 minutes and then rinsed in water. The remaining cone specimens were not passivated. All of the specimens were tested by exposure to a controlled environment having 95% relative humidity at 95° F. (35° C.) for 200 hours and then inspected for the presence of corrosion.

Shown in Table 5A below are the results of the corrosion testing of the passivated cone specimens of each heat, including the heat treatment process used (Process) and a qualitative evaluation of the degree of corrosion (Test Results) that the specimens from each set underwent. Table 5B shows the results for the unpassivated specimens.

TABLE 5A

| {Passivated} | | |
|---|---|---|
| I.D. | Process | Test Results |
| Ex. 1 | A1 | Several small areas of rust. |
| Ht. A | A1 | Several small areas of rust. |
| Ex. 1 | T1 | Several small areas of rust; pit on one sample. |

TABLE 5A-continued

| {Passivated} | | |
|---|---|---|
| I.D. | Process | Test Results |
| Ht. A | T1 | Several small areas of rust; pit on one sample. |

TABLE 5B

| {Unpassivated} | | |
|---|---|---|
| I.D. | Process | Test Results |
| Ex. 1 | A1 | Several small areas of rust; several pits. |
| Ht. A | A1 | Several small areas of rust; several pits. |
| Ex. 1 | T1 | Several small areas of rust; several pits. |
| Ht. A | T1 | Several small areas of rust; several pits. |

The data presented in Tables 3A to 4C show that Example 1 of the present alloy provides superior form tool machinability relative to Heats A and B in the annealed condition and relative to Heat A in the intermediate hardened condition (26–32 HRC). This significant improvement in machinability is obtained without sacrificing hardness capability because, as noted above, Example 1 provided an as-quenched hardness of 38 HRC using a known hardening heat treatment and quench. Moreover, the data in Tables 5A and 5B show that Example 1 has corrosion resistance that is essentially the same as Heat A. Thus, the improvement in form tool machinability provided by the present alloy is obtained without sacrificing corrosion resistance.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention as claimed.

What is claimed is:

1. A martensitic stainless steel alloy having a unique combination of form tool machinability, hardness capability, and corrosion resistance, said alloy consisting essentially of, in weight percent, about

| | wt. % |
|---|---|
| Carbon | 0.06–0.10 |
| Manganese | 0.50 max. |
| Silicon | 0.40 max. |
| Phosphorus | 0.060 max. |
| Sulfur | 0.15–0.55 |

-continued

| | wt. % |
|---|---|
| Chromium | 12.00–12.60 |
| Nickel | 0.25 max. |
| Molybdenum | 0.10 max. |
| Copper | 0.50 max. |
| Aluminum | 0.02 max. |
| Nitrogen | 0.04 max. |

and the balance is essentially iron, wherein the elements are balanced such the % Chromium Equivalent is not greater than about 9.5%, where % Chrornium Equivalent=% Cr+% Si+1.5×% Mo+10×% Al−% Ni−% Cu−30(% C+% N).

2. An alloy as set forth in claim 1 containing not more than about 0.35% silicon.

3. An alloy as set forth in claim 1 containing not more than about 0.20% nickel.

4. An alloy as set forth in claim 1 containing not more than about 12.50% chromium.

5. A martensitic stainless steel alloy having a unique combination of form tool machinability, hardness capability, and corrosion resistance, said alloy consisting essentially of, in weight percent, about

| | wt. % |
|---|---|
| Carbon | 0.06–0.10 |
| Manganese | 0.50 max. |
| Silicon | 0.35 max. |
| Phosphorus | 0.060 max. |
| Sulfur | 0.15–0.50 |
| Chromium | 12.00–12.50 |
| Nickel | 0.20 max. |
| Molybdenum | 0.10 max. |
| Copper | 0.50 max. |
| Aluminum | 0.02 max. |
| Nitrogen | 0.04 max. |

and the balance is essentially iron, wherein the elements are balanced such the % Chromium Equivalent is not greater than about 9.5%, where % Chromium Eciuivalent=% Cr+% Si+1.5×% Mo+10×% Al−% Ni−% Cu−30(% C+% N).

6. The alloy as set forth in any of claims 1–4 wherein the % Chromium Equivalent is not greater than about 9.0%.

7. The alloy as set forth in any of claims 1–4 wherein the % Chromium Equivalent is not greater than about 8.75%.

8. The alloy as set forth in claim 5 wherein the % Chromium Equivalent is not greater than about 9.0%.

9. The alloy as set forth in claim 5 wherein the % Chromium Equivalent is not greater than about 8.75%.

* * * * *